US011585120B2

(12) United States Patent
Arlinghaus

(10) Patent No.: US 11,585,120 B2
(45) **Date of Patent: *Feb. 21, 2023**

(54) ELECTRIC STRIKE WITH SELECTABLE CHANNEL LOCATION

(71) Applicant: Schlage Lock Company LLC, Carmel, IN (US)

(72) Inventor: Paul R. Arlinghaus, Fishers, IN (US)

(73) Assignee: Schlage Lock Company LLC, Carmel, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/505,192

(22) Filed: Oct. 19, 2021

(65) Prior Publication Data

US 2022/0213717 A1 Jul. 7, 2022

Related U.S. Application Data

(63) Continuation of application No. 16/214,562, filed on Dec. 10, 2018, now Pat. No. 11,149,469.

(51) Int. Cl.

| | |
|---|---|
| ***E05B 47/00*** | (2006.01) |
| ***E05B 55/00*** | (2006.01) |
| ***E05B 15/02*** | (2006.01) |

(52) U.S. Cl.

CPC ..... *E05B 47/0047* (2013.01); *E05B 15/025* (2013.01); *E05B 15/0245* (2013.01); *E05B 55/005* (2013.01)

(58) Field of Classification Search

CPC ..... E05B 47/0046; E05B 47/0047; E05B 15/021; E05B 15/0245; E05B 15/025;

(Continued)

(56) References Cited

U.S. PATENT DOCUMENTS 7,011,348 B2 * 3/2006 Milo ..... E05B 15/024 292/DIG. 60

8,146,966 B1 * 4/2012 Webb ..... E05B 47/0047 292/341.15

(Continued)

FOREIGN PATENT DOCUMENTS

WO 2018005075 A1 1/2018

OTHER PUBLICATIONS

International Search Report; International Searching Authority; International Application No. PCT/US2019/065471; dated Apr. 8, 2020; 2 pages.

(Continued)

*Primary Examiner* — Christine M Mills
*Assistant Examiner* — Yahya Sidky
(74) *Attorney, Agent, or Firm* — Taft Stettinius & Hollister LLP

(57) ABSTRACT

An electric strike system including a housing, a keeper, an actuator, and a plurality of ramp members. The keeper is pivotally mounted to the housing, and is pivotable about a longitudinal axis between a closed position and an open position. The actuator is operable to selectively retain the keeper in the closed position. Each ramp member is operable to be mounted to the housing and includes a corresponding and respective channel. The plurality of ramp members includes a first ramp member and a second ramp member. With the first ramp member mounted to the housing, the channel of the first ramp member has a first longitudinal position relative to the housing. With the second ramp member mounted to the housing, the channel of the second ramp member has a second longitudinal position relative to the housing. The second longitudinal position is different from the first longitudinal position.

20 Claims, 5 Drawing Sheets

(58) Field of Classification Search
CPC .... E05B 55/005; E05B 63/244; E05C 9/1808; E05C 9/004; Y10T 292/68; Y10T 292/696; Y10T 292/699; Y10T 292/702; Y10T 292/705; Y10T 292/707; Y10S 292/65
See application file for complete search history.

(56) References Cited

U.S. PATENT DOCUMENTS

| | | | | |
|---|---|---|---|---|
| 8,157,302 | B1 | 4/2012 | Webb et al. | |
| 8,465,067 | B2 | 6/2013 | Webb et al. | |
| 2002/0163210 | A1* | 11/2002 | Galindo ..... | E05B 47/0046 292/341.16 |
| 2005/0127692 | A1 | 6/2005 | Sanders | |
| 2009/0072555 | A1 | 3/2009 | Holzer | |
| 2009/0188289 | A1 | 6/2009 | Orbeta | |
| 2010/0096864 | A1 | 4/2010 | Webb et al. | |
| 2013/0328332 | A1 | 12/2013 | Scheffler et al. | |

OTHER PUBLICATIONS

Written Opinion of the International Searching Authority, International Searching Authority; International Application No. PCT/US2019/065471; Apr. 8, 2020; 5 pages.
Canadian Examination Report; Canadian Intellectual Property Office; Canadian Application No. 3,123,000; dated Sep. 28, 2022; 5 pages.

* cited by examiner

ELECTRIC STRIKE WITH SELECTABLE CHANNEL LOCATION

CROSS REFERENCE TO RELATED APPLICATIONS

The present application is a continuation of U.S. patent application Ser. No. 16/214,562 filed Dec. 10, 2018 and issued as U.S. Pat. No. 11,149,469, the contents of which are incorporated herein by reference in their entirety.

TECHNICAL FIELD

The present disclosure generally relates to electric strikes, and more particularly but not exclusively relates to electric strikes having a cylindrical format.

BACKGROUND

Electric strikes are commonly utilized in closure assemblies to selectively retain a door in a closed position. The strikes are typically installed to a doorframe, and receive a portion of a latchbolt installed to a door when the door is in the closed position. Certain electric strikes include ramps that, when the strike is in an unlocked state, depress the latchbolt as the door is moved to an open position. Some electric strikes of this type are configured for use with deadlocking latchbolt mechanisms, which include a latchbolt and an auxiliary bolt positioned adjacent the latchbolt. When the auxiliary bolt is in a depressed position, internal deadlocking features of the latchbolt mechanism prevent depression of the latchbolt. Thus, certain electric strikes configured for use with such deadlocking latchbolt mechanisms include channels that enable the auxiliary bolt to return to its projected position as the door is opened, thereby enabling depression of the latchbolt by the ramp.

Many conventional electric strikes of the type described above do not enable the installer to select the location of the channel. Thus, problems can arise when the channel is not properly aligned with the auxiliary bolt. For these reasons among others, there remains a need for further developments in this technological field.

SUMMARY

An exemplary electric strike system includes a housing, a keeper, an actuator, and a plurality of ramp members. The keeper is pivotally mounted to the housing, and is pivotable about a longitudinal axis between a closed position and an open position. The actuator is operable to selectively retain the keeper in the closed position. Each ramp member is operable to be mounted to the housing and includes a corresponding and respective channel. The plurality of ramp members includes a first ramp member and a second ramp member. With the first ramp member mounted to the housing, the channel of the first ramp member has a first longitudinal position relative to the housing. With the second ramp member mounted to the housing, the channel of the second ramp member has a second longitudinal position relative to the housing. The second longitudinal position is different from the first longitudinal position. Further embodiments, forms, features, and aspects of the present application shall become apparent from the description and figures provided herewith.

DETAILED DESCRIPTION OF ILLUSTRATIVE EMBODIMENTS

Figure 2:
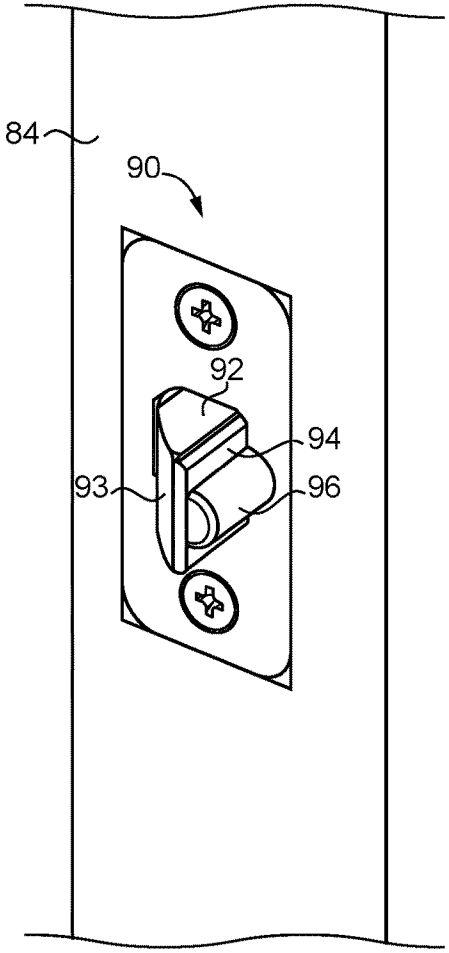
FIG. 2 is a perspective illustration of a latchbolt mechanism installed to a door.

Although the concepts of the present disclosure are susceptible to various modifications and alternative forms, specific embodiments have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. It should further be appreciated that although reference to a "preferred" component or feature may indicate the desirability of a particular component or feature with respect to an embodiment, the disclosure is not so limiting with respect to other embodiments, which may omit such a component or feature. Further, when a particular feature, structure, or characteristic is described in connection with an embodiment, it is submitted that it is within the knowledge of one skilled in the art to implement such feature, structure, or characteristic in connection with other embodiments whether or not explicitly described.

Additionally, it should be appreciated that items included in a list in the form of "at least one of A, B, and C" can mean (A); (B); (C); (A and B); (B and C); (A and C); or (A, B, and C). Similarly, items listed in the form of "at least one of A, B, or C" can mean (A); (B); (C); (A and B); (B and C); (A and C); or (A, B, and C). Further, with respect to the claims, the use of words and phrases such as "a," "an," "at least one," and/or "at least one portion" should not be interpreted so as to be limiting to only one such element unless specifically stated to the contrary, and the use of phrases such as "at least a portion" and/or "a portion" should be interpreted as encompassing both embodiments including only a portion of such element and embodiments including the entirety of such element unless specifically stated to the contrary.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures unless indicated to the contrary. Additionally, the inclusion of a structural or method feature in a particular figure is not meant to imply that such feature is required in all embodiments and, in some embodiments, may not be included or may be combined with other features.

Figure 1:
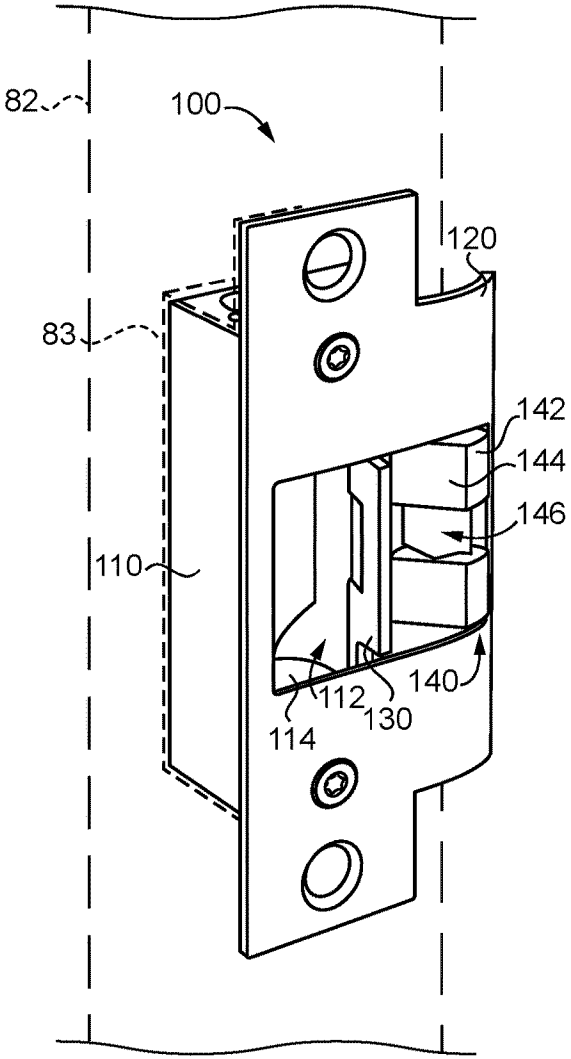
FIG. 1 is a perspective illustration of a strike according to certain embodiments.

With reference to FIG. 1, illustrated therein is an electric strike 100 according to certain embodiments. The strike 100 is mounted to a doorframe 82 having a cutout 83, and generally includes a housing 110, a faceplate 120 mounted to the housing 110, a keeper 130 pivotably mounted in the housing 110, and a ramp member 140 secured to the housing 110. As described herein, the strike 100 further comprises an electromechanical actuator 150 (FIG. 3) operable to selectively prevent pivoting of the keeper 130 from a closed position.

With additional reference to FIG. 2, the strike 100 is configured for use with a deadlocking latchbolt mechanism 90, which is mounted to a door 84 that is swingingly mounted to the doorframe 82. The latchbolt mechanism 90 includes a latchbolt 92 and an auxiliary bolt 96 mounted adjacent the latchbolt 92. The latchbolt 92 has a beveled face 93 and a flat face 94 opposite the beveled face 93. The auxiliary bolt 96 is mounted adjacent the flat face 94. The latchbolt 92 has an extended position and a retracted position and is biased toward the extended position. Similarly, the auxiliary bolt 96 has a projected position and a depressed position, and is biased toward the projected position.

When the auxiliary bolt 96 is in its projected position, the latchbolt 92 is free to move from its extended position toward its retracted position under an external pushing force, such as one exerted on the beveled face 93. Such movement of the latchbolt 92 causes a corresponding movement of the auxiliary bolt 96 from its projected position toward its depressed position. When the auxiliary bolt 96 is in its depressed position, the latchbolt 92 is free to move from its retracted position toward its extended position. Once the latchbolt 92 reaches the extended position, however, internal deadlocking features of the latchbolt mechanism 90 prevent the external pushing forces from driving the latchbolt 92 to its retracted position, thereby deadlocking the latchbolt 92 in its extended position.

Figure 3:
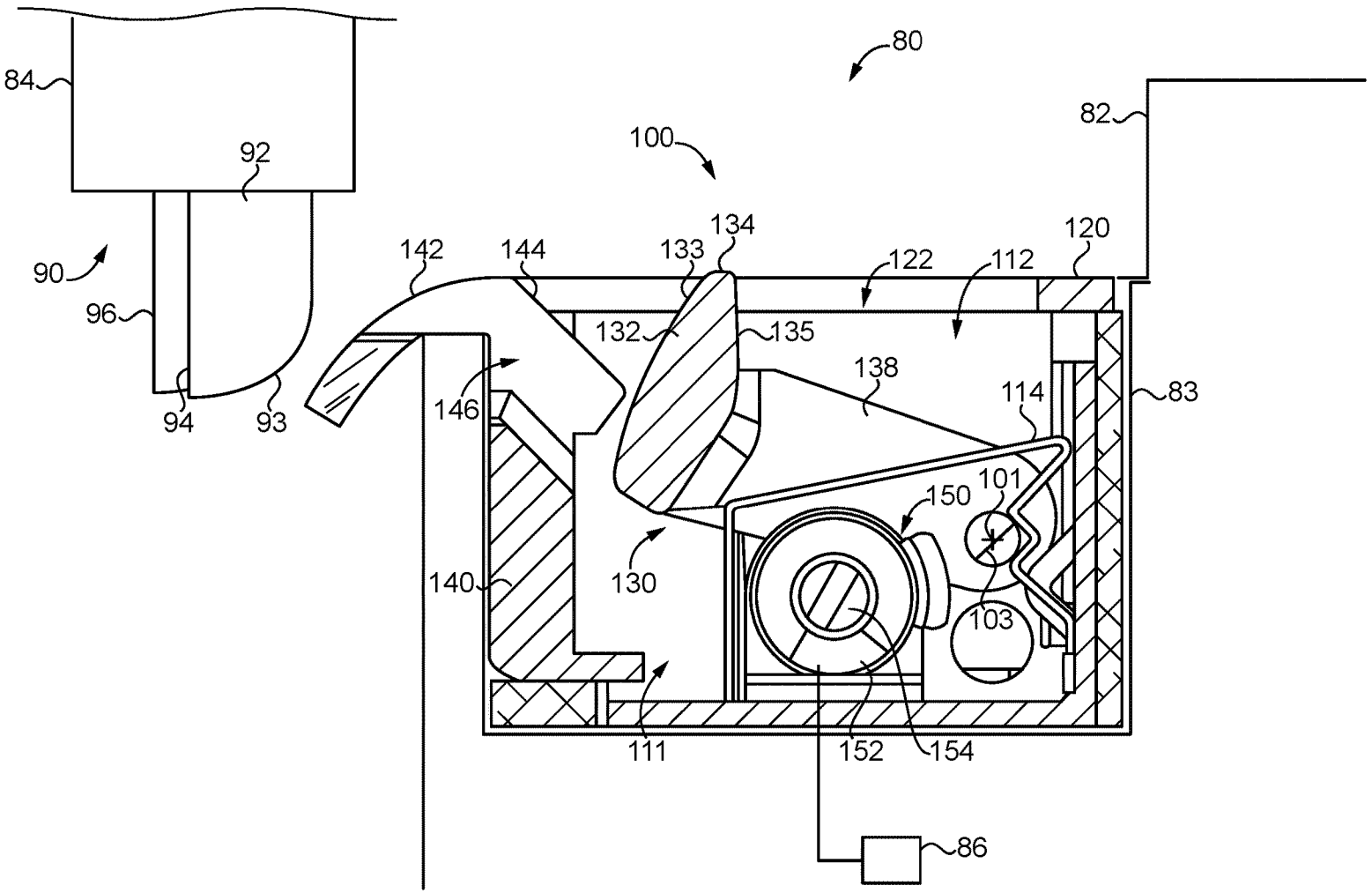
FIG. 3 is a cross-sectional illustration of the strike as the door moves toward a closed position.

With additional reference to FIG. 3, the housing 110 defines a chamber 111 in which various internal components of the strike 100 are housed, including the keeper 130 and the actuator 150. A pivot pin 103 extends along a longitudinal axis 101 through the housing 110, and the keeper 130 is pivotally mounted to the housing 110 via the pivot pin 103. A shield plate 114 is seated in the chamber 111, and partially defines a pocket 112 operable to receive the latchbolt 92. The faceplate 120 is mounted to the housing 110, and includes an opening 122 that opens to the pocket 112.

Figure 5:
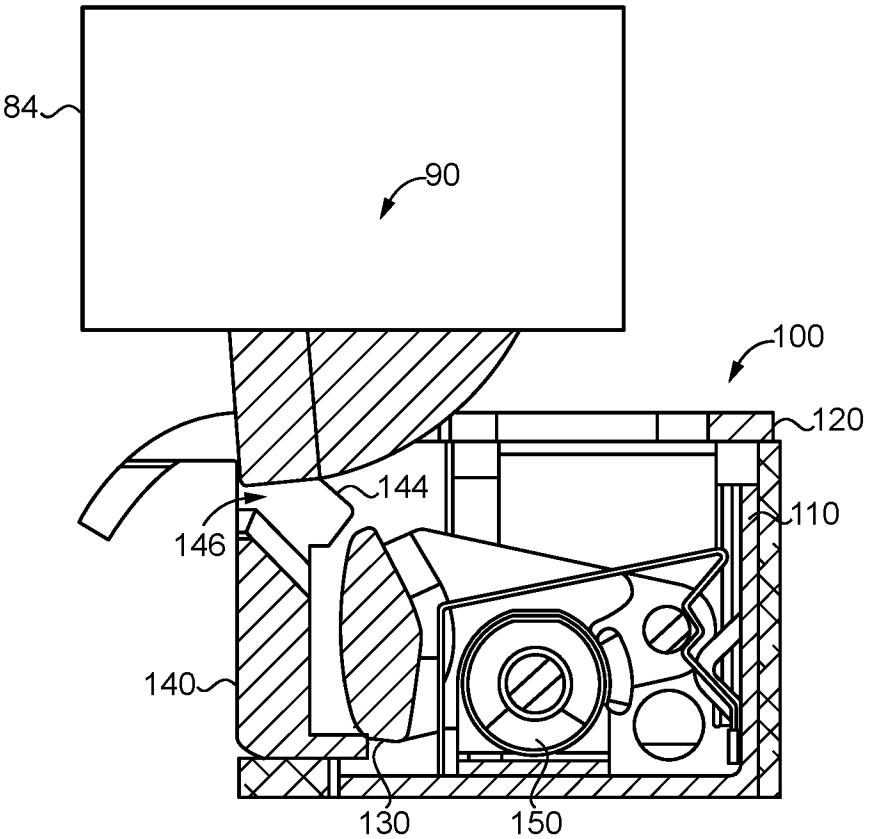
FIG. 5 is a cross-sectional illustration of the strike as the door moves toward an open position.

The keeper 130 generally includes a keeper body 132 and a pair of keeper arms 138 extending from the keeper body 132. The keeper arms 138 engage the pivot pin 103 such that the keeper 130 is operable to pivot about the longitudinal axis 101 between a closed position (FIGS. 3 and 4) and an open position (FIG. 5). Additionally, the keeper 130 is biased toward the closed position. The keeper body 130 includes a front face defining a keeper ramp 133 that faces the ramp member 140, an opposite rear face defining a wall 135, and an edge 134 connecting the keeper ramp 133 and the wall 135. When the keeper 130 is in the closed position, the wall 135 partially encloses the pocket 112. When the keeper 130 is in the open position, the pocket 112 is open to the ramp member 140. As described herein, the keeper 130 is operable to pivot between the closed position and the open position when the strike 100 is in an unlocked state.

The ramp member 140 is secured to a front end of the housing 110, and generally includes a front ramp 142 facing outwardly from the strike 100, a rear ramp 144 facing the keeper 130, and a channel 146 operable to receive the auxiliary bolt 96. Further details regarding the ramp member 140 are provided below with reference to FIGS. 6 and 7.

The actuator 150 is mounted to the housing 110 within the chamber 111, and generally includes a body portion 152 and a reciprocating plunger 154 that moves between a first position and a second position under the urging of the body portion 152. One of the first position or the second position is a locking position, and the other of the first position or the second position is an unlocking position. When in the locking position, the plunger 154 blocks pivotal movement of one of the keeper arms 138, thereby retaining the keeper 130 in the closed position. When in the unlocking position, the plunger 154 does not block pivotal movement of the keeper arm 138, and the keeper 130 is free to pivot from its closed position to its open position as described in further detail below. In certain embodiments, the actuator 150 may be provided in the form of a solenoid, in which case the body portion 152 may be provided in the form of a solenoid core. In other embodiments, the actuator 150 may be provided in the form of a motor-driven linear actuator, and the body portion 152 may be provided as a rotary motor that, when actuated, linearly drives the plunger 154 between its first and second positions.

The actuator 150 is connected to an access control system 86 that provides the actuator 150 with power to which the actuator 150 is responsive. More particularly, the access control system 86 selectively provides the power to cause the plunger 154 to move between its first position and its second position. In certain forms, the plunger 154 may be biased toward the first position, and the body portion 152 may drive the plunger 154 to its second position upon receiving power from the access control system 86. The position to which the plunger 154 is biased may provide the strike 100 with either fail-safe/electric locking (EL) functionality on the one hand, or fail-secure/electric unlocking (EU) functionality on the other hand. For example, the plunger 154 may be biased toward the unlocking position and electrically driven to the locking position to provide the strike 100 with fail safe functionality. Conversely, the plunger 154 may be biased toward the locking position and electrically driven to the unlocking position to provide the strike 100 with fail secure functionality.

While one example of EL/EU selection has been provided, it is to be appreciated that the selection of EL/EU functionality may be performed in another manner. For example, where the actuator 150 is a motor-driven linear actuator, the strike 100 may further include an energy storage device that stores energy when power is connected, and which discharges energy to the actuator 150 to cause the actuator to move the plunger 154 from the second position to the first position when power is cut.

Figure 4:
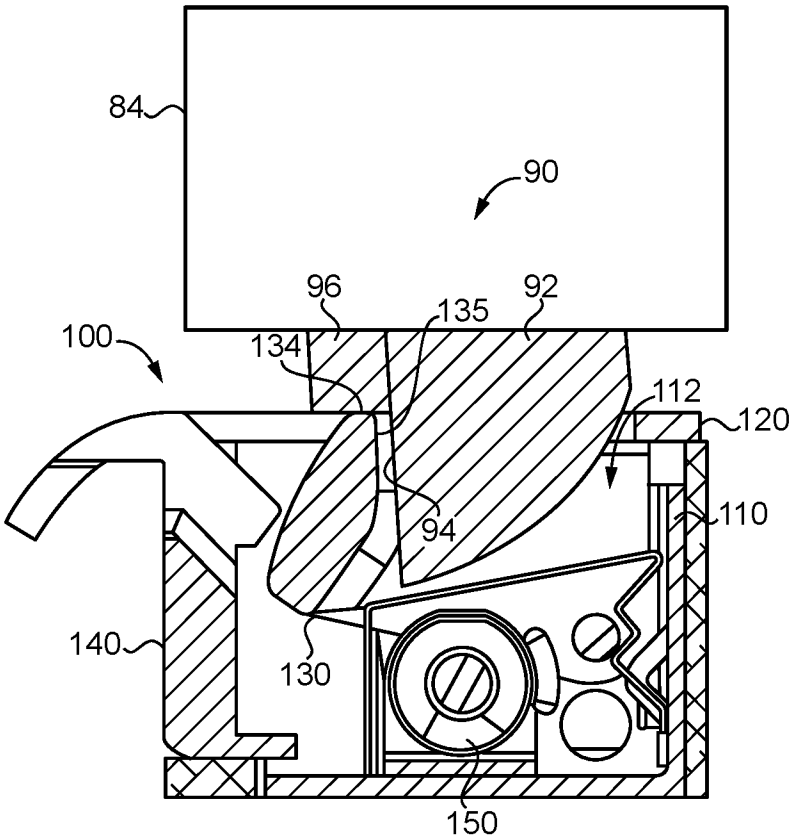
FIG. 4 is a cross-sectional illustration of the strike with the door in the closed position.

With additional reference to FIGS. 4 and 5, further details regarding the operation of the strike 100 will now be provided. FIGS. 3-5 illustrate the strike 100 and the latchbolt mechanism 90 during various stages of an opening/closing cycle of the door 84. More particularly, FIG. 3 illustrates a stage in which the door 84 is moving from a partially-closed position to a fully-closed position, FIG. 4 illustrates a stage in which the door 84 is in the fully-closed position, and FIG. 5 illustrates a stage in which the door 84 is moving toward an open position.

With the door 84 in the partially-closed position (FIG. 3), the latchbolt 92 is in its extended position, the auxiliary bolt 96 is in its projected position, and the beveled face 93 of the latchbolt 92 faces the front ramp 142. As the door 84 moves toward its closed position, the front ramp 142 engages the beveled face 93 and urges the latchbolt 92 toward its retracted position, thereby driving the auxiliary bolt 96 toward its depressed position. Due to the fact that the auxiliary bolt 96 begins in its projected position, this urging of the front ramp 142 is operable to drive the latchbolt 92 toward its retracted position. As the door 84 continues to move toward its fully closed position, the keeper ramp 133 likewise engages the beveled face 93 and urges the latchbolt 92 toward its retracted position.

When the door 84 reaches its fully closed position (FIG. 4), the latchbolt 92 becomes aligned with the pocket 112. The internal biasing forces of the latchbolt mechanism 90 thus drive the latchbolt 92 toward its extended position and into the pocket 112. However, the edge 134 of the keeper body 132 engages the auxiliary bolt 96, thereby retaining the auxiliary bolt 96 in its depressed position. Thus, when the door 84 is in the fully closed position, the latchbolt mechanism 90 deadlocks the latchbolt against being driven to its retracted position by tampering forces exerted on the end of the latchbolt 92.

In the state illustrated in FIG. 4, the keeper 130 is in its closed position such that the wall 135 defines a forward boundary of the pocket 112. In the event that the door 84 is urged toward the open position while the latchbolt 92 is in its extended position, the flat face 94 of the latchbolt engages the wall 135 of the keeper 130, thereby urging the keeper 130 toward its open position. When the plunger 154 is in its locking position, such pivotal movement of the keeper 130 is prevented, and the door 84 cannot be opened without retracting the latchbolt 92. When the plunger 154 is in its unlocking position, the keeper 130 is capable of pivoting to its open position, and opening of the door 84 can continue.

As the door 84 moves toward its open position (FIG. 5), the auxiliary bolt 96 clears the keeper 130 and moves to its projected position. Continued opening movement of the door 84 causes the auxiliary bolt 96 to enter the channel 146, which allows the auxiliary bolt 96 to remain in its projected position. As noted above, when the auxiliary bolt 96 is in its projected position, the latchbolt 92 is able to be driven to its retracted position by externally-applied pushing forces. Such a pushing force is provided by the rear ramp 144 as the door 84 travels in the opening direction, thereby urging the latchbolt 92 toward its retracted position.

As should be evident from the foregoing, the configuration of the ramp member 140 and the alignment of the ramp member 140 with the latchbolt mechanism 90 are important factors in ensuring proper operation of the closure assembly 80. For example, the channel 146 must be large enough to accommodate the auxiliary bolt 96 during opening movement of the door 84, but small enough to ensure that the latchbolt 92 engages the front and rear ramps 142, 144 during opening and closing movement of the door 84. Additionally, the channel 146 also must be aligned with the auxiliary bolt 96 to ensure that the bolt 96 does not engage the rear ramp 144 during the opening movement, as such engagement would drive the auxiliary bolt 96 to its depressed position, thereby preventing subsequent depression of the latchbolt 92.

During the installation process, the installer may initially form the cutout 83 at the location he or she believes will provide proper alignment between the auxiliary bolt 96 and the channel 146. Alternatively, the cutout 83 may be preformed in the doorframe 82, and the installer may have no choice regarding the location of the cutout 83. Upon installation of the strike 100, the installer may identify a misalignment between the auxiliary bolt 96 and the channel 146. For certain existing strikes, such a misalignment would require the installer to enlarge the cutout 83 and reinstall the strike at a location in which the auxiliary bolt aligns with the channel. However, such a requirement is obviated by the current strike 100, which is provided with a family of ramp members, each of which provides a different longitudinal position for the channel 146.

Figure 6:
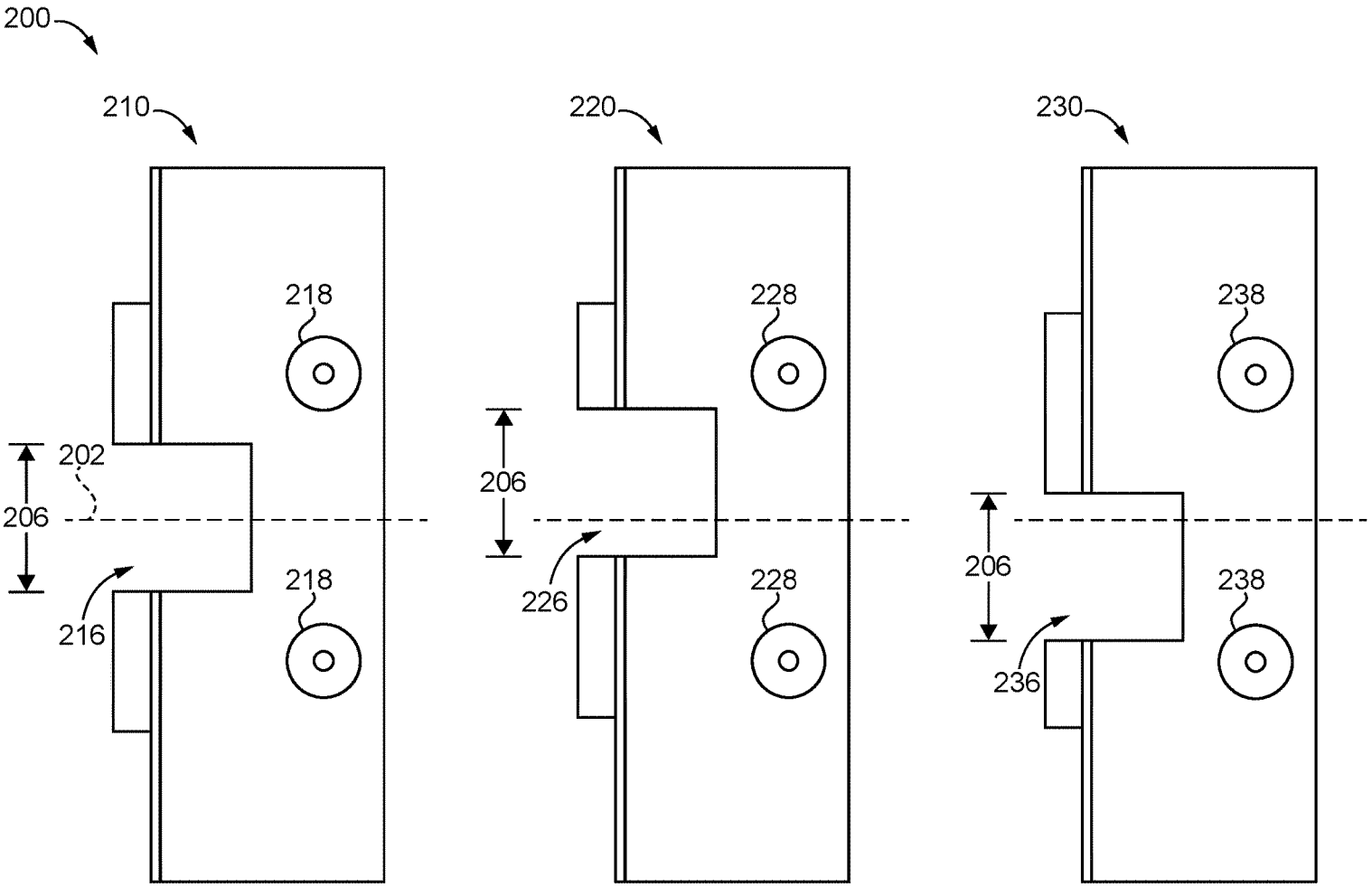
FIG. 6 is a plan view of a ramp member family according to certain embodiments.

With additional reference to FIG. 6, illustrated therein is a ramp member family 200 including a plurality of ramp members 210, 220, 230, each of which is operable to be installed to the strike 100 for use as the ramp member 140. Each ramp member 210, 220, 230 includes a corresponding and respective channel 216, 226, 236. Each channel 216, 226, 236 is formed at a different longitudinal position such that the position of the channel 146 relative to the housing 110 is selectable. Each of the channels 216, 226, 236 has a longitudinal width dimension 206, which may be about one half inch.

Each ramp member 210, 220, 230 also includes a corresponding and respective pair of fastener openings 218, 228, 238 positioned on opposite sides of a central lateral axis 202. Each pair of openings 218, 228, 238 is configured to align with a corresponding pair of openings in the housing 110 to facilitate the use of fasteners such as screws by which the ramp members 210, 220, 230 can be mounted to the housing 110. In certain forms, the housing 110 includes a single corresponding pair of openings such that each ramp member 210, 220, 230 is operable to be mounted to the housing 110 in only a single location. In addition to facilitating proper installation of the ramp members 210, 220, 230, providing such a non-adjustable mounting location may provide for a more secure coupling between the selected ramp member 210, 220, 230 and the housing 110, thereby preventing undesired movement of the channel 146.

The first ramp member 210 has a centrally-located channel 216 that is generally centered on the lateral axis 202 of the ramp member 210. The second ramp member 220 has an offset channel 226, the center of which is offset from the lateral axis 202 in a first direction (upward in FIG. 6). The third ramp member 230 likewise has an offset channel 236, the center of which is offset from the lateral axis 202 in a second direction opposite the first direction (downward in FIG. 6). Thus, each of the channels 216, 226, 236 has a unique longitudinal position relative to the lateral axis 202, the position of which relative to the housing 110 is fixed by the position of the fastener openings 218, 228, 238 and the openings in the housing 110. As a result, each of the ramp members 210, 220, 230, when installed to the strike 100, provides the channel 146 at a different longitudinal position relative to the housing 110.

Figure 7C:
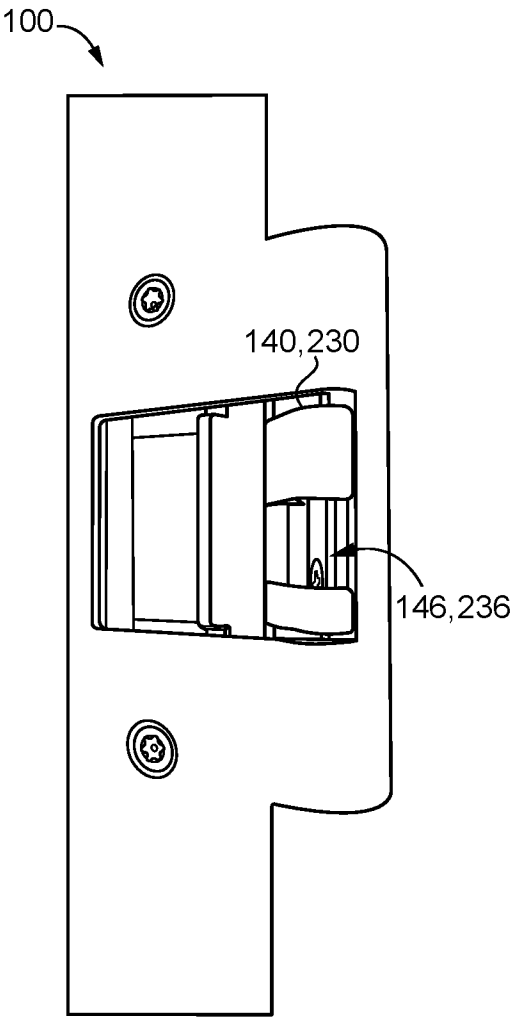
FIG. 7C illustrates the strike with a third ramp member installed thereto.
Figure 7B:
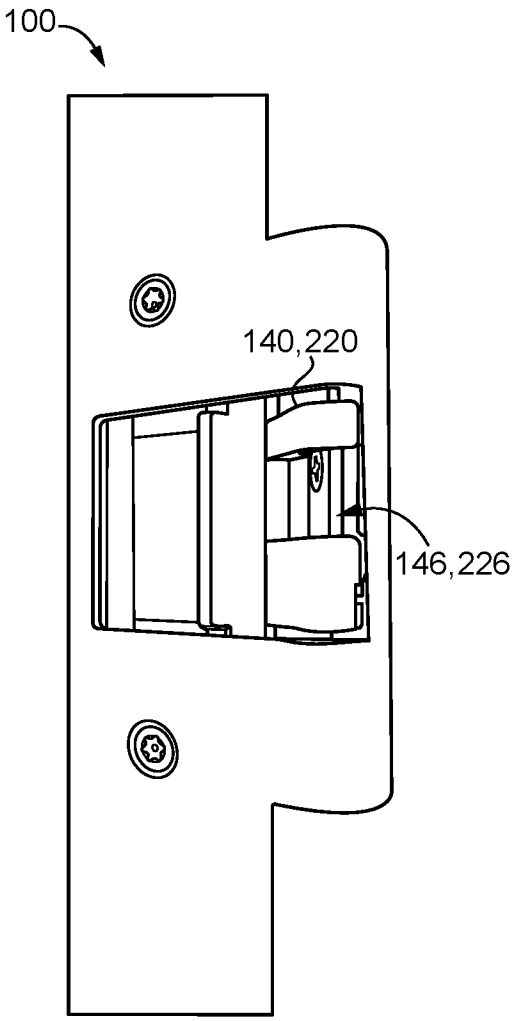
FIG. 7B illustrates the strike with a second ramp member installed thereto.
Figure 7A:
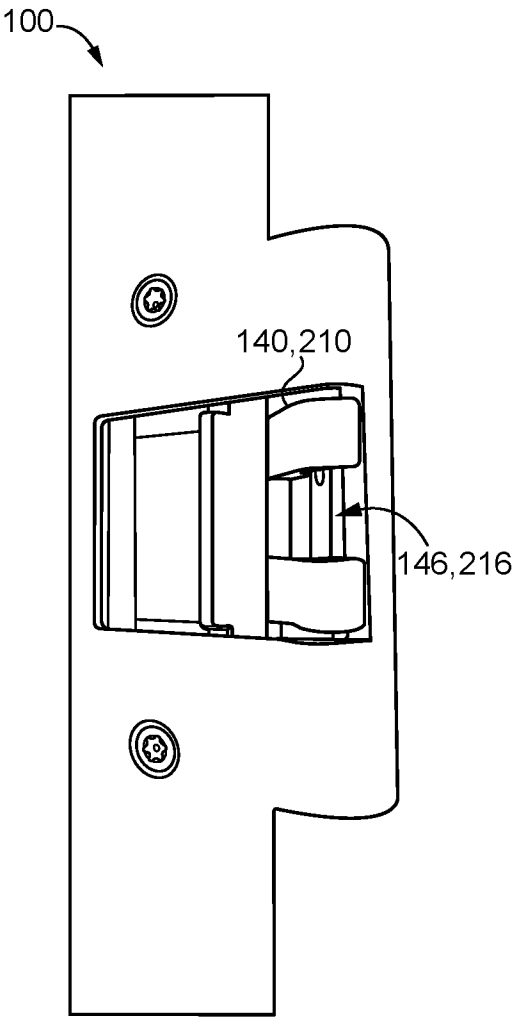
FIG. 7A illustrates the strike with a first ramp member installed thereto.

With additional reference to FIGS. 7A-7C, illustrated therein is the strike 100 with each of the ramp members 210, 220, 230 installed thereto. With the first ramp member 210 installed as the ramp member 140 (FIG. 7A), the channel 146/216 is provided at a central longitudinal location. When the second ramp member 220 is installed as the ramp member 140 (FIG. 7B), the channel 146/226 is provided at an upper longitudinal location, which is different from the central longitudinal location. Conversely, when the third ramp member 230 is installed as the ramp member 140 (FIG. 7C), the channel 146/236 is provided at a lower longitudinal location, which is different from both the central longitudinal location and the upper longitudinal location. Thus, by selecting the appropriate ramp member 210, 220, 230 from the ramp member family 200, the position of the channel 146 can be selected, thereby obviating the need to enlarge the cutout 83 and reposition the strike 100.

During installation of the strike 100, the installer may first select one ramp member 210, 220, 230 for installation to the strike 100. For example, the installer may first select the first ramp member 210, and may secure the first ramp member 210 to the housing at the predetermined location defined by the fastener openings 218 and the openings in the housing 110. Alternatively, the strike 100 may come prepackaged with one ramp member (e.g., the first ramp member 210) mounted to the housing 110. The installer may then install the strike 100 in the cutout 83 in the ordinary fashion, and subsequently test the closure assembly 80 for alignment between the auxiliary bolt 96 and the channel 146. If the auxiliary bolt 96 and the channel are properly aligned, the installation may be completed.

In the event that the auxiliary bolt 96 and the channel 146 are misaligned, the installer identifies such misalignment. After identifying the misalignment, the installer removes the first ramp member 210 from the housing 110, and mounts another ramp member to the housing 110. The installer may select the new ramp member to be installed based upon the identified misalignment. For example, should the channel 146 be positioned too low to receive the auxiliary bolt 96, the installer may select and install the second ramp member 220, the channel 226 of which is positioned higher than the centrally-located channel 216 of the first ramp member 210. Conversely, in the event that the channel 146 is positioned too high to receive the auxiliary bolt 96, the installer may select and install the third ramp member 230, the channel 236 of which is positioned lower than the centrally-located channel 216 of the first ramp member 210. Once the channel 146 has been provided in the appropriate location, the installation may be completed as usual.

As should be evident from FIGS. 6 and 7, the various positions of the channel 146 overlap one another. More particularly, the position of the channel 146 provided by the first ramp member 210 overlaps the position of the channel 146 provided by each of the second ramp member 220 and the third ramp member 230. In the illustrated form, the channel positions provided by the second and third ramp members 220, 230 also overlap one another. Additionally, in the illustrated form, the distance between the channel position provided by the first ramp member 210 and the channel position provided by the second ramp member 220 is equal to the distance between the channel position provided by the first ramp member 210 and the channel position provided by the third ramp member 230.

The offset distances, and thus the amount by which the channel positions overlap one another, are selected such that each misalignment within a range of misalignments can be accommodated by selection of an appropriate ramp member. As a result, the ramp member family 200 can accommodate a continuous range of misalignments despite the fact that the channel positions are provided as a set of discrete options. Thus, the current system can provide both the advantages of accommodating a continuous range of misalignments and the advantages of providing a single, predefined mounting location for the ramp member 140.

While the invention has been illustrated and described in detail in the drawings and foregoing description, the same is to be considered as illustrative and not restrictive in character, it being understood that only the preferred embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. Door strike componentry, comprising:

a housing;

a first ramp member and a second ramp member, each independently and separately mountable to the housing and each defining a corresponding and respective channel;

wherein, with the first ramp member mounted to the housing, the channel of the first ramp member has a first longitudinal position relative to the housing; and wherein, with the second ramp member mounted to the housing, the channel of the second ramp member has a second longitudinal position relative to the housing that is different from the first longitudinal position.

2. The door strike componentry of claim 1, wherein when the first and second ramp members are independently and separately mounted to the housing, the first longitudinal position and the second longitudinal position overlap one another.

3. The door strike componentry of claim 1, further comprising a third ramp member defining a third channel; and wherein, with the third ramp member mounted to the housing, the third channel has a third longitudinal position relative to the housing, the third longitudinal position being different from each of the first longitudinal position and the second longitudinal position.

4. The door strike componentry of claim 3, wherein when the first, second and third ramp members are independently and separately mounted to the housing, the first longitudinal position overlaps each of the second longitudinal position and the third longitudinal position.

5. The door strike componentry of claim 4, wherein when the second and third ramp members are independently and separately mounted to the housing, the second longitudinal position and the third longitudinal position overlap one another.

6. The door strike componentry of claim 3, wherein a first distance between the first longitudinal position and the second longitudinal position is equal to a second distance between the first longitudinal position and the third longitudinal position.

7. The door strike componentry of claim 1, wherein each of the first ramp member and the second ramp member is operable to be mounted to the housing in a single position.

8. The door strike componentry of claim 1, wherein each of the first ramp member and the second ramp member includes a corresponding and respective pair of discrete fastener openings configured to align with a pair of fastener openings formed in the housing.

9. The door strike componentry of claim 1, wherein each of the first ramp member and the second ramp member comprises:

a front ramp that faces a first direction relative the housing; and a rear ramp that faces a second direction relative to the housing that is different from the first direction.

10. The door strike componentry of claim 1, wherein the housing and each of the first ramp member and the second ramp member cooperate to define a single location at which each of the first and second ramp members is operable to be mounted to the housing.

11. The door strike componentry of claim 1, wherein the first ramp member is removably attached to the housing at a predetermined location, and wherein the second ramp member is operable to be removably attached to the housing at the predetermined location.

12. The door strike componentry of claim 11, wherein each of the first ramp member and the second ramp member is operable to be attached to the housing at only the predetermined location.

13. The door strike componentry of claim 1, further comprising a keeper pivotally mounted to the housing, wherein the keeper is pivotable about a longitudinal axis between a closed position and an open position.

14. The door strike componentry of claim 13, further comprising an actuator operable to selectively retain the keeper in the closed position.

15. A method, comprising:

installing a door strike to a doorframe having a door swingingly mounted thereto, wherein the door has mounted thereto a latchbolt mechanism comprising a latchbolt and an auxiliary bolt, wherein the door strike comprises a housing and a first ramp member mounted to the housing, the first ramp member including a first channel having a first longitudinal position relative to the housing;

identifying a misalignment between the auxiliary bolt and the first channel; and in response to the identifying, removing the first ramp member and mounting a second ramp member to the housing, wherein the second ramp member includes a second channel having a second longitudinal position relative to the housing when the second ramp member is mounted to the housing.

16. The method of claim 15, wherein mounting the first ramp member to the housing and mounting the second ramp member to the housing each comprise mounting the corresponding ramp member to the housing at a single, predefined location.

17. The method of claim 15, further comprising selecting the second ramp member from a plurality of ramp members based upon the identified misalignment.

18. The method of claim 15, wherein the plurality of ramp members further comprises a third ramp member including a third channel having a third longitudinal position relative to the housing when the third ramp member is mounted to the housing.

19. The method of claim 15, wherein the first ramp member is mounted to the housing at a predetermined position; and wherein mounting the second ramp member to the housing comprises mounting the second ramp member to the housing at the predetermined position.

20. Door strike componentry, comprising:

a housing comprising a housing fastener opening;

a first ramp member and a second ramp member, each independently and separately mountable to the housing;

the first ramp member comprising a first channel and a first ramp member fastener opening operable to align with the housing fastener opening to thereby define a first ramp member installation position in which the first channel has a first longitudinal position relative to the housing; and the second ramp member comprising a second channel and a second ramp member fastener opening operable to align with the housing fastener opening to thereby define a second ramp member installation position in which the second channel has a second longitudinal position relative to the housing; and wherein the first longitudinal position and the second longitudinal position are different.

* * * * *